United States Patent [19]

Bailey et al.

[11] Patent Number: 4,751,754

[45] Date of Patent: Jun. 21, 1988

[54] DUAL HYDRAULIC HOSPITAL BED WITH EMERGENCY BYPASS CIRCUIT

[75] Inventors: David W. Bailey, Moores Hill, Ind.; Michael J. Duwell, Cincinnati, Ohio; William H. Peck, Oldenburg, Ind.

[73] Assignee: Hill-Rom Company, Inc., Batesville, Ind.

[21] Appl. No.: 34,232

[22] Filed: Apr. 2, 1987

[51] Int. Cl.[4] ..... A61G 7/00

[52] U.S. Cl. ..... 5/68; 5/69

[58] Field of Search ..... 5/66, 67, 68, 69, 72, 5/60, 63

[56] References Cited

U.S. PATENT DOCUMENTS

| | | | |
|---|---|---|---|
| 2,217,783 | 10/1940 | Bell . | |
| 3,149,349 | 9/1964 | Nelson | 5/66 |
| 3,281,141 | 10/1966 | Smiley et al. | 269/325 |
| 4,038,709 | 8/1977 | Kerwit | 5/68 |
| 4,559,655 | 12/1985 | Peck | 5/66 |
| 4,667,354 | 5/1987 | Carby et al. | 5/66 |

*Primary Examiner*—Alexander Grosz

*Attorney, Agent, or Firm*—Steve M. McLary; F. Kristen Koepcke

[57] ABSTRACT

A hydraulically operated hospital bed with dual hydraulic power systems for operation with or without electrical service. The bed has its head and thigh/leg elevation functions performed by hydraulic cylinders. A control circuit meters the introduction and removal of hydraulic fluid from these cylinders so an occupant of the bed is not subjected to any sudden movement. In case of an emergency requiring the bed occupant to be in a supine position (the need to perform CPR), the normal control circuit is bypassed by an emergency circuit that allows much faster than normal lowering of the head and thigh/leg portions of the bed.

4 Claims, 4 Drawing Sheets

DUAL HYDRAULIC HOSPITAL BED WITH EMERGENCY BYPASS CIRCUIT

BACKGROUND OF THE INVENTION

There have been numerous examples of hydraulic hospital beds and medical procedure tables in the prior art. These devices use hydraulic cylinders to raise and lower the bed itself and the head and leg adjustment portions. Other hospital beds are electrically operated. In the case of electrically operated beds, disengagement of the mechanical drive member will allow quick lowering of head and leg portions in case of an emergency. Hydraulically operated beds generally have not had this capability because their rods usually are directly coupled to the head and leg portions, leading to a generally slow lowering rate, even in an emergency when cardiac-pulmonary resuscitation (CPR) might be required.

U.S. Pat. No. 4,038,709 shows a hospital bed that has a dual hydraulic system, operable by either compressed air or a manual foot pump. This bed does have a way to allow rapid lowering of the head and foot sections in an emergency, but it is mechanical.

U.S. Pat. No. 3,149,349 illustrates another design for a hydraulically driven hospital bed. U.S. Pat. No. 3,281,141 illustrates a hydraulically operated surgical table. The surgical table is powered by both an electrical pump and a foot operated pump. U.S Pat. No. 2,217,783 illustrates yet another hydraulically operated operating table. The operating table in this case has a dual pumping system for the hydraulic power, having both an electrical and hand operated pump. U.S. Pat. No. 4,559,655 illustrates an electrical operated hospital bed having a means to rapidly lower the head and foot portions in an emergency.

SUMMARY OF THE INVENTION

The present invention resides in an improved hydraulic system for a hospital bed. The hospital bed is of the type having a generally rigid platform that has attached to it movable patient supporting surfaces. The patient supporting surfaces are generally designated as the head, thigh and leg portions. These are movable to and from horizontal and elevated positions. The improved hydraulic system uses cylinders having extensible and retractable rods attached to the movable patient surfaces to articulate these surfaces. The cylinders are powered by a hydraulic power source which obtains fluid from and returns fluid to a hydraulic fluid reservoir. Control valve means are connected in the hydraulic circuit to allow introduction of and removal of the hydraulic operating fluid. The cylinders can be selectively operated to allow articulation of the various sections. There is also an emergency bypass hydraulic circuit means that can drain hydraulic fluid from the cylinders to the reservoir without using the control valve circuit thus allowing a faster lowering of the head, thigh and leg portions in an emergency than is allowed by normal operation through the control valve circuit.

DETAILED DESCRIPTION OF A PREFERRED EMBODIMENT OF THE INVENTION

Figure 1:
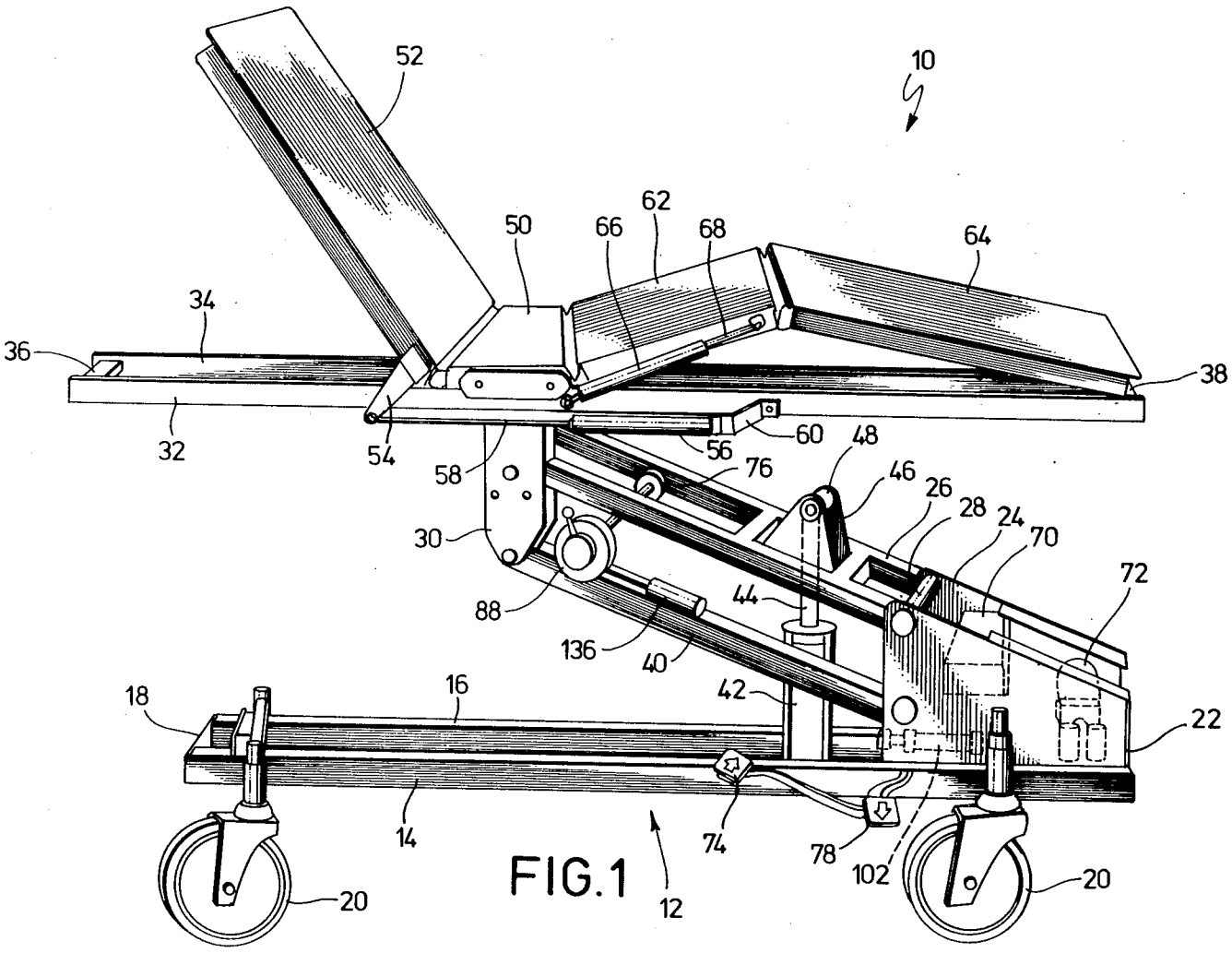
FIG. 1 is a perspective view of a hospital bed of the present invention with most of its cover plates removed.

FIG. 1 illustrates a hospital bed, generally designated by the numeral 10, of the type which is sold by the Hill-Rom Company, Inc. under the designation of Century CC hospital bed. The bed 10 illustrated in FIG. 1 is shown with most of the cosmetic moldings and enclosures which normally surround it removed. This is done in order to better see the hydraulic system of the present invention. The bed 10 includes a base frame 12 which is made up of longitudinal members 14 and 16 which are tied together by a pair of transverse members only one of which, 18, is visible in FIG. 1. Attached to the base frame 12 are four large casters designated as 20. Only two of these casters are visible in FIG. 1, but it may be appreciated that the two opposing casters are on the opposite side and serve to support the frame 12 in a mobile fashion. Two generally triangular, vertically extending bosses 22 and 24 are attached to the foot end of the bed 10. These bosses 22 and 24 serve as a pivot mounting for a cantilevered support arm 26. The cantilevered support arm 26 is hingedly attached to the bosses 22 and 24 through a pivot pin 28. The cantilever arm 26 is attached at its end remote from the pivot pin 28 to two brackets, only one of which 30 is visible in FIG. 1. The bracket 30 and its corresponding bracket on the opposite side, which is not visible in this view, are attached to two longitudinal frame members 32 and 34. The frame members 32 and 34 are then tied together by transverse members 36 and 38 to form a rigid platform that will move with the brackets 30. Also attached to the bracket 30 is a stabilizing arm 40 which is pivoted to the boss 22. The stabilizing arm 40 moves with the cantilevered arm 26 to provide a stabilizing function as the cantilevered arm 26 moves. The cantilever arm 26 is driven by a hydraulic cylinder 42 which has an extensible rod 44 that is attached to a clevis mount 46 on the cantilever arm 26. The clevis mount 46 has a pin 48 which connects the clevis mount 46 to the rod 44. The base of the cylinder 42 is attached to the members 14 and 16. It may be appreciated that as the rod 44 is extended and retracted its movement will in turn be transferred through the clevis mount 46 and pin 48 to the cantilevered arm 26. Extension and retraction of the rod 44 will move the cantilevered arm 26 up and down. The position shown in FIG. 1 is an essentially fully extended or up position for the cantilevered arm 26. It may be appreciated that retraction of the rod 44 will then cause the cantilever arm 26 to retract, bringing with it the frame attached to the brackets 30.

As is the case with most hospital beds, the bed 10 has provided means for articulating portions of the bed to achieve various positions of the patient supporting surface. The patient supporting surface itself is carried by the longitudinal frame members 32 and 34. The patient support surface is made up of several elements. There is a fixed seat element 50 which does not move. Adjacent to the head portion of the bed 10 there is a head member 52 on which a patient's upper body portion would normally rest and which may be articulated from a fully down position resting on the frame numbers 32 and 34 to the fully up position shown in FIG. 1. The head portion 52 is raised and lowered through a crank mechanism 54 that is actuated by a hydraulic cylinder 56 having an extensible rod 58 which is attached to and drives the crank mechanism 54. Note that the hydraulic cylinder 56 is attached to the longitudinal frame member 32 by a bracket 60. In FIG. 1, only one hydraulic cylinder 56 is visible to drive the head portion 52. However, it is preferred that two hydraulic cylinders be used, one carried by the frame member 32 and the other on the opposite side carried by the frame member 34. The second hydraulic cylinder is not visible in FIG. 1, but it will be shown later in describing the operation of the hydraulic circuit of the present invention. The head elevation function would work with only one cylinder 56, but two cylinders provide a smoother motion and less chance of binding of the crank mechanism 54. Two additional portions of the patient support surface are a thigh portion 62 and a leg portion 64. The thigh portion 62 and leg portion 64 are pinned together so that they move as a unit. They are also pinned to the fixed seat portion 50 so that they may be elevated as shown in FIG. 1. Actuation of the thigh portion 62 will cause corresponding raising of the leg portion 64. The thigh portion 62 is raised and lowered by a hydraulic cylinder 66 having an extensible rod 68 that is attached to the thigh portion 62. Extension and retraction of the rod 68 will cause corresponding movement of the thigh portion 62 and leg portion 64. None of the hydraulic piping or valves necessary for operation of this system are shown in FIG. 1 to avoid unnecessary complication. FIG. 1 does show that a reservoir for hydraulic fluid 70 is carried between the two vertical bosses 22 and 24. Also carried between the bosses 22 and 24 is a power pack 72 for providing electrical pumping power for the hydraulic system and a manual pump 102. Also shown in FIG. 1 are the manual operation pedals for operation of the hydraulic system of the present invention in a manual mode. That is, a pedal and lever 74 are marked so that a person by pumping on the lever 74 will provide hydraulic pressure to the system by operation of the manual pump 102. The hydraulic pressure thus provided may be directed by means of a manual selector valve 76. The manual selector valve is used only in a manual operation mode as will be shown with respect to the discussion of the hydraulic circuit of the present invention. The manual selector valve 76 and an emergency valve 136 are operated by a rotatable dial 88. To lower or to release pressure provided to the system by the manual pump lever 74, a release lever 78 is provided. Standing on the release lever 78 will allow hydraulic pressure to be released from the system so that the components of the system may return to their original configuration.

Figure 2:
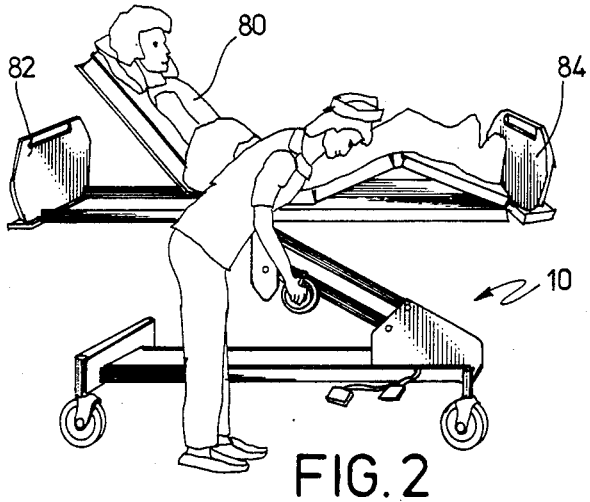
FIG. 2 is a perspective view of the hospital bed of the present invention showing a patient in an elevated position.
Figure 3:
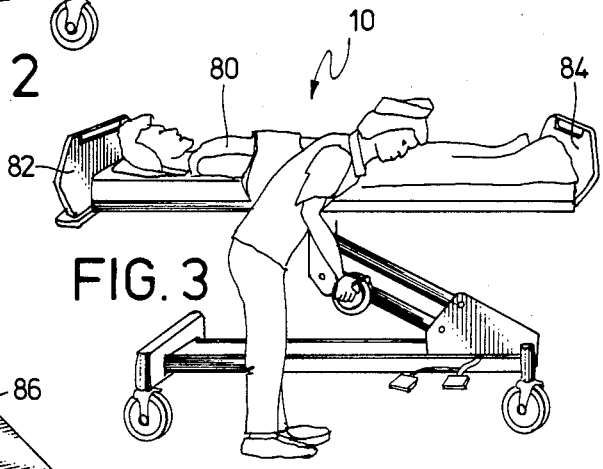
FIG. 3 is a view similar to FIG. 2 showing the patient returned to a supine position.
Figure 4:
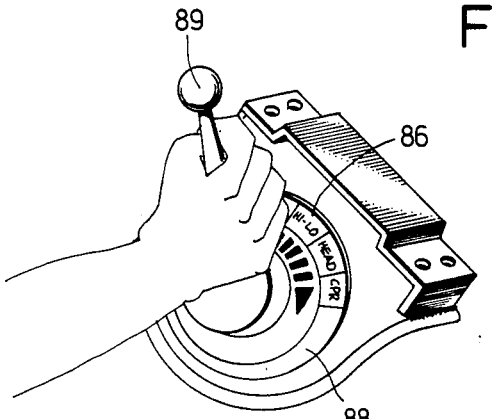
FIG. 4 is a perspective view of the manual selection valve of the present invention.

FIGS. 2, 3 and 4 illustrate the CPR mode of operation of the present invention. Hydraulic systems which provide for operation both manually and with electrical power are known in the art. However, one problem with these systems is that they have not provided for achieving a CPR mode, a mode in which the patient is flat and on a relatively hard surface, in a short period of time. In FIG. 2, the bed 10 of the present invention as described in FIG. 1 is shown with a patient 80 occupying the sleep surface, having been raised to the position generally shown in FIG. 1. A headboard 82 and a footboard 84 have been added to the bed 10 as would normally be the case in use. The normal operation of the bed 10 is such that it take approximately twenty seconds to raise the thigh and leg portion 62 and 64 and approximately twenty seconds to retract them to their flat position from the raised position shown in FIG. 2. The head portion 52 requires approximately thirty seconds to reach its fully elevated position shown in FIG. 2 and correspondingly approximately thirty seconds to retract to its fully flat position. Thus if the patient 80 suffers a cardiac arrest and immediate CPR is required, the time required to lower the head section 52 and thigh and leg section 62 and 64 is on the order of one half minute. This time can be critical in a emergency situation and needs to be improved upon.

Figure 4A:
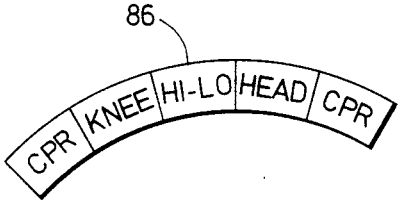
FIG. 4A is a plan view of the indicia window for the manual selection mode.

FIG. 3 shows the patient 80 having reached the fully flat position from the position shown in FIG. 2. The present invention allows the bed in question to move from the position shown in FIG. 2 to the position shown in FIG. 3 when in an emergency mode in approximately four to eight seconds. This is done by providing a special valve in the hydraulic circuit and a special setting on the the rotatable dial 88. FIG. 4 illustrates that one of the settings on the rotatable dial 88 shows a "CPR" in the indicia window 86 of the rotatable dial 88. The rotatable dial 88 is moved by a lever 89 which is easily grasped by a nurse or other medical staff. The manual selector valve 76 actually controls only the bed functions while a separate valve 136, discussed in detail with respect to FIG. 5, controls the emergency down function. The dial 88 and lever 89, however, are configured to show and control the CPR function for convenience. Moving the lever 89 to either extreme position of the rotatable dial 88 and holding it there will cause the CPR emergency down function to take place. To avoid accidental engagement of this feature, the lever 89 must be held in place by hand. If the lever 89 is released, it will spring to one of the other positions of the manual selector valve 76. As FIG. 4A shows, other indications such as head, knee or hi/low will appear in the indicia window 86 as the rotatable dial 88 is moved to other positions indicated by the manual selector valve 76. FIG. 4A also shows the CPR indicia at the two ends of the indicia window 86. Note that in the movement from FIG. 2 to FIG. 3 the overall height of the bed 10 has not changed. The present invention does not quickly release the pressure in the cylinder 42 which raises and lowers the bed 10, because this would create an unacceptable and potentially dangerous downward movement of the patient at a critical time. Rather, all that is required is that the patient be made flat in a very short period of time to allow the application of CPR.

Figure 5:
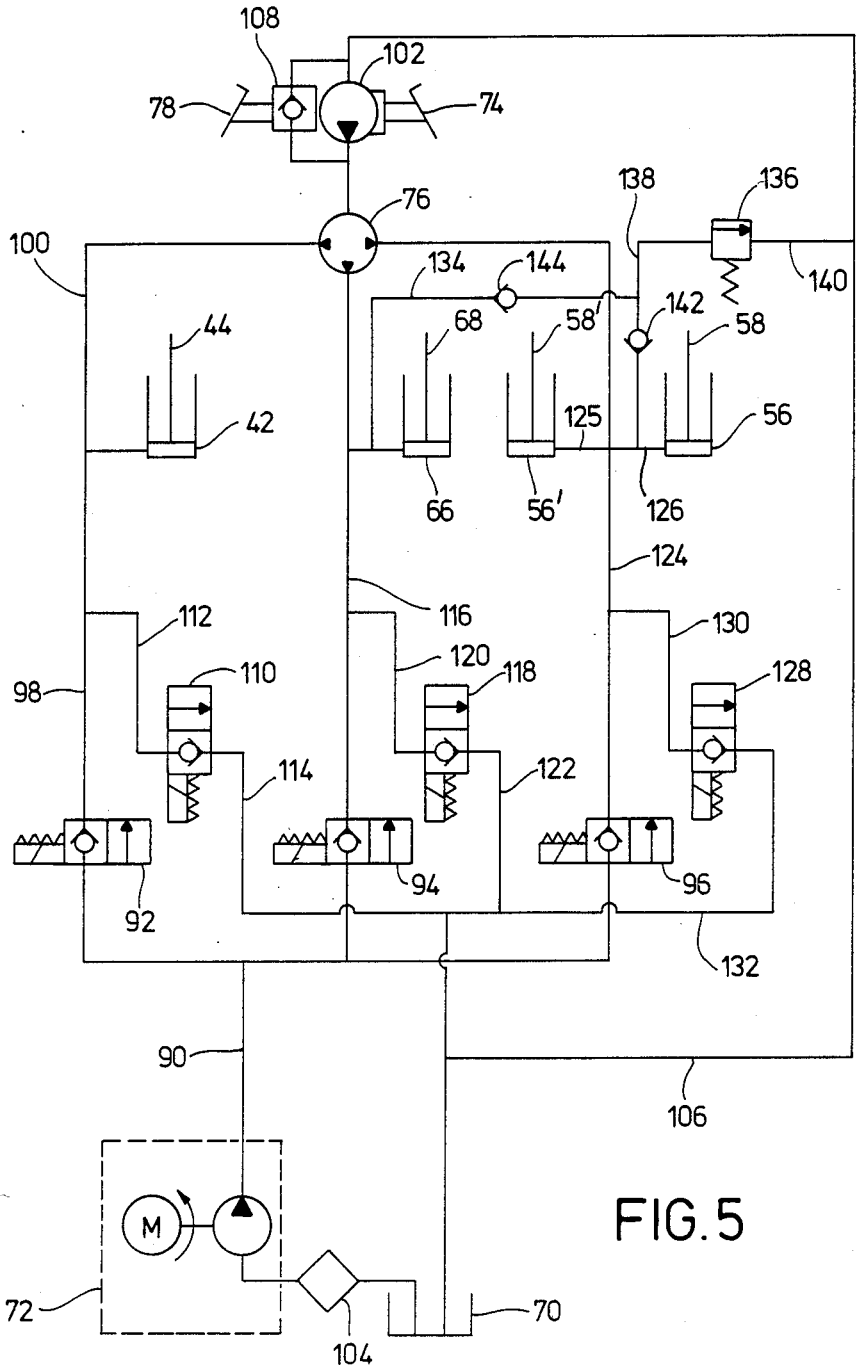
FIG. 5 is a schematic circuit diagram for the hydraulic system of the present invention.

FIG. 5 shows the hydraulic circuit of the present invention in a standard hydraulic schematic form. The power pack 72 is seen to consist of an electric motor and a pump which provides pressure in a line 90 that splits to feed three substantial identical solenoid operated valves 92 94 and 96. The solenoid valve 92 which serves as an extension valve is a normally closed valve which will allow hydraulic pressure from the line 90 to flow through an outlet line 98 to cylinder 42 which raises the bed 10 when the valve 92 is actuated. The hydraulic cylinder 42 in addition to being able to receive hydraulic working fluid through the valve 92 and the line 98 may also be provided hydraulic working fluid through a line 100 which is connected to the manual selector valve 76. The manual selector valve 76 can be rotated to allow hydraulic fluid to flow from a foot operated pump 102 into any one of the hydraulic cylinders. Both the foot pump 102 and the power pack 72 obtain their working hydraulic fluid from the hydraulic reservoir 70. The reservoir 70 serves as a source for the hydraulic working fluid to the entire system. Before the hydraulic fluid enters the power pack 72.it passes through a filter 104. There is a separate branch line 106 which connects the reservoir 70 to the foot pump 102. As was previously noted, the foot pump 102 may be operated by the foot pedal 74. Bypassing the pump 102 is a normally closed check valve 108. The normally closed check valve may be opened by operation of the pedal 78. When the check valve 108 is opened by operation of the foot pedal 78, fluid may return to the reservoir 70 along the line 106 by passing through selector valve 76 from any of the cylinders which have been pressurized at that point.

Returning now to the hydraulic cylinder 42, the hydraulic cylinder 42 is of the single acting type. That is its rod 44 is extended by applying pressure through the line 98 to the cylinder 42. If the solenoid valve 92 is then closed, pressure will be trapped in the line 98 and the rod 44 will remain extended. To retract the rod 44, a solenoid valve 110 which is normally closed is actuated to allow fluid to flow back along the line 98 but then through a branch line 112 into the solenoid valve 110 from whence the fluid exits through a branch line 114 to return to the reservoir 70. With pressure trapped in the lines 98 and 112 and the solenoid valves 92 and 110 both closed, the rod 44 will stay in the position where it was placed. When the solenoid valve 110 is actuated the rod 44 will slowly retract as a result of the weight on it, and thus bring the cantilevered arm 26 downward and retract the entire bed toward the floor. It can be seen that this function is basically the same with the foot powered pump 102. The manual selector valve 76 is set so that pressure from the foot pump 102 is directed to the cylinder 42. When the rod 44 has reached the desired extended position ceasing operation of the foot pump 102 leaves the line 100 pressurized. In order to relieve the pressure, the foot pedal 78 is depressed, opening the check valve 108 and allowing pressure to return through the line 100 and line 106 to the reservoir 70.

The operation of all of the cylinders, 42, 56, and 66 are all substantially identical to the operation thus described. The solenoid valves 92, 94 and 96 are all identical and may be operated from controls located on the bed 10, either in the guard rail or at the foot of the bed. The pump outlet line 90 is also connected to the inlet of the normally closed solenoid valve 94 which serves as a retraction valve. A line 116 from the normally closed solenoid valve 94 is connected to the hydraulic cylinder 66 which operates the thigh and leg portions of the patient support surface. In the electrically operated mode, pressure from the pump will flow through the outlet line 90 and with the solenoid valve 94 actuated to its open position, then flow through the line 116 to operate the cylinder 66 and extend the rod 68. This then will move the thigh portion 62 and leg portion 64 to the upright position shown in FIG. 1. When the solenoid valve 94 is closed, pressure will remain in the line 116 and the rod 68 will remain in the position where it was placed. In order to retract the rod 68 and allow the thigh portion 62 and leg portion 64 to return to their flat position, a normally closed electrically operated solenoid valve 118 will be opened. The solenoid valve 118 is connected to a branch line 120 which is connected to the line 116. The outlet of the solenoid valve 118 is then connected to the reservoir 70 through a hydraulic line 122. Thus, actuation of the solenoid valve 118 will allow the pressure that was presert in the cylinder 66 to be released by returning the hydraulic operating fluid to the reservoir 70 through the line 116, 120 and 122. This will allow the rod 68 to retract. The alternative mode of operation of the cylinder 66 through the manual selector valve 76 is quite similar to that previously described with respect to the cylinder 42. The manual selector valve 76 is set at such that operation of the foot powered pump 102 by the pedal 74 will cause pressure to be exerted inside the cylinder 66 and cause actuation or extension of the rod 68. Then, opening of the check valve 108 through the foot pedal 78 will cause this pressure to be released and returned to the reservoir 70 through the line 106. Note that the line 106 serves the function of both supply and return with respect to the manual operational mode.

While only one cylinder 56 was shown operating the head portion 52, the actual configuration of two cylinders is shown in FIG. 5. These cylinders are designated as 56 and 56'. The cylinders 56 and 56' are both operated simultaneously through the solenoid valve 96. The solenoid valve 96 is connected to the outlet line 90 to the power pack 72. The solenoid valve 96 is a normally closed valve and its actuation will allow pressurized operating fluid to simultaneously flow to both the cylinders 56 and 56' through an inlet line 124 and branch connectors 125 and 126. Actuation of the cylinders 56 and 56' will cause their respective rods 58 and 58' to be extended and raise the head portion 52 as seen in FIG. 1. Again, pressure may be trapped in the lines 124, 125 and 126 by closing the solenoid valve 96 after the pressurized fluid has been furnished and the rods 58 and 58' have been extended. To release the pressure on the cylinders 56 and 56', a solenoid valve 128 which is normally closed is opened. This then allows the operating fluid in the cylinders 56 and 56' to flow through the line 124 and a branch connector 130 connected to the solenoid valve 128. When the solenoid valve 128 is opened, the operating fluid will then flow through it and out a line 132 and from there to the reservoir 70.

The solenoid valves 94, 96, 118, 128, the manual selector valve 76 and the check valve 108 all serve as a first hydraulic control valve means to control functioning of the head portion 52, thigh portion 62, leg portion 64 and their associated operating hydraulic cylinders. The solenoid valves 98 and 110 and the manual selector valve 76 and the check valve 108 serve as a second hydraulic control valve means to control the bed raising and lowering cylinder 42.

One of the key features of the present invention is the ability to lower the head portion 52, the thigh portion 62 and the leg portion 64 very quickly in the case of an emergency. The solenoid valves 118 and 128 are fixed to allow a certain flow of hydraulic fluid through them when they are actuated. This flow is calculated to allow a relatively gradual lowering of the portions which they control. This avoids unnecessary jarring and uncomfortable feelings on the part of the patient. However, in an emergency, the need to maintain the patient in a flat position overcomes other considerations of comfort and ease. Therefore, a bypass circuit is provided for emergency cases. A bypass line 134 is connected to the cylinder 66 and to an emergency CPR valve 136. The emergency CPR valve 136 is a spring operated normally closed valve. This is a mechanical valve to allow operation whether the bed 10 is in the electrically operated mode or in the manually operated mode. It is important that the valve 136 be manually operated to avoid any problems with failure of electrical power or accessability of electrical power. The cylinders 56 and 56' are also connected through a bypass line 138 to the emergency valve 136. Both the lines 134 and 138 are tied together at the inlet to the emergency CPR valve 136. The emergency CPR valve 136 is normally closed and the bypass lines 134 and 138 normally have no role to play. However, should an emergency occur, actuation of the emergency valve 136 by hospital personnel will allow an immediate drain of hydraulic pressure from the cylinders 66, 56 and 56' through the bypass lines 134 and 138, out the valve 136, and through a line 140 connected to the line 106 which returns to the reservoir 70. Check valves 142 and 144 are connected in bypass lines 138 and 134 respectively to prevent cross flow of hydraulic fluid when the emergency valve 136 is opened. It would be possible for pressurized fluid to bleed from line 134 into line 138 (or vice versa) when valve 136 was opened were the check valves 142 and 144 not provided.

As was previously pointed out, the normal operation time for the cylinder 66 is approximately twenty seconds to both extend the rod 68 and retract the rod 68. Normal operational time for the cylinders 56 and 56' is approximately thirty seconds. The emergency CPR valve 136 is sized such that operation of the valve 136 will allow the cylinders 66, 56 and 56' to completely retract in four to eight seconds. This means that a patient will be able to be moved from the position as shown in FIG. 2 to the position as shown in FIG. 3 in approximately four to eight seconds as opposed to approximate thirty seconds if the solenoid valve system using the valves 118 and 128 were used. Because of the speed of operation, use of the valve 136 provides a somewhat abrupt downward motion to the components of the bed 10, but it does allow quick positioning of the patient for performance of emergency procedures.

Figure 6:
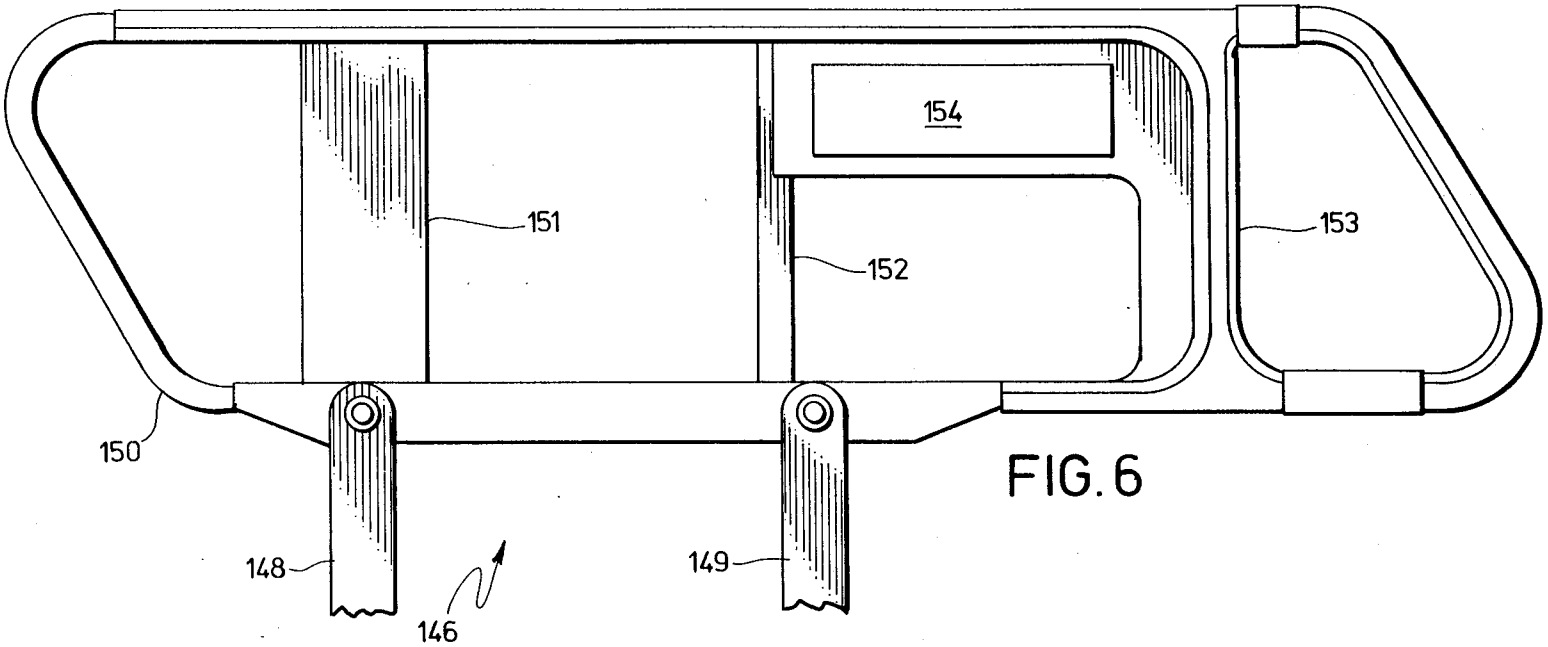
FIG. 6 is a side elevational view of a guard rail for the hospital bed of the present invention.

FIG. 6 shows a sideguard 146 of the type usually used with the bed 10. The sideguard 146 is the half length type and there would normally be two on each side of the bed. The side guard 146 is attached to the bed 10 through support brackets 148 and 149. These are connected to allow a pivoting motion of the sideguard 146 from a position above the frame members 32 and 34 to a position below them. The sideguard 146 has a generally continuous perimeter member 150 which is connected by web members 151, 152 and 153. A bed control panel 154 is positioned between the web member 152 and 153.

Figure 7:
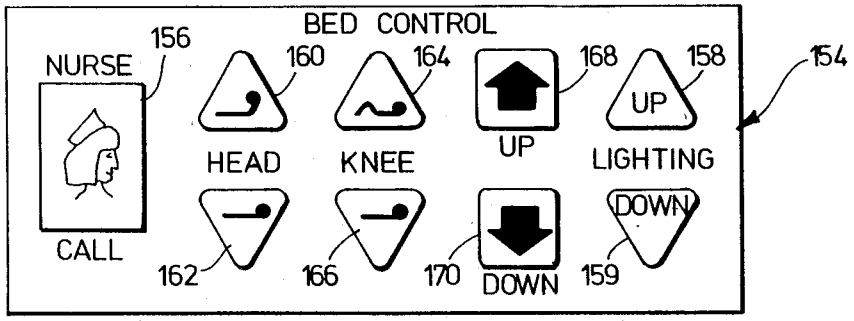
FIG. 7 is a plan view of a bed function control panel for the hospital bed of the present invention.

FIG. 7 shows the bed control panel 154 in more detail. The bed control panel 154 carries a number of electrical switches which control various functions. A nurse call switch 156 will activate a signal at the nursing station when pressed. Lighting switch 158 and 159 will control the room and overbed lights. A head up switch 160 will turn on the power pack 72 and open the valve 96 when it is activated. This will cause the head portion 52 to be raised by the action of the cylinders 56 and 56'. A head down switch 162 will activate the valve 128 and cause hydraulic fluid to return to the reservoir 70 and the head portion 52 to drop. A knee up switch 164 will turn on the power pack 72 and open the valve 94. This will cause the cylinder 66 to operate and raise the thigh portion 62 and leg portion 64. Conversely operation of a knee down switch 166 will open the valve 118, causing hydraulic fluid to return to the reservoir 70 and the thigh portion 62 and leg portion 64 to return to their horizontal position. When a bed up switch 168 is operated, the power pack 72 will operate and the valve 92 will be opened. This will cause the cylinder 42 to operate and raise the entire bed 10. To lower the bed 10, a bed down switch 170 is activated. This will cause the valve 110 to open and allow hydraulic fluid to return to the reservoir 70.

What is claimed is:

1. In combination with a hospital bed of the type having a generally rigid platform which has attached to it movable patient supporting surfaces, said movable patient supporting surfaces being movable from a generally horizontal position to an elevated position and including head, thigh and leg portions, an improved hydraulic system including:

A. A plurality of hydraulic cylinders having extensible and retractable operating rodsad having said operating rods connected to said head, leg and thigh portions, whereby movement of said operating rods will move said head, leg and thigh portions;

B. A source of hydraulic fluid under pressure connected to said hydraulic cylinders, said source of hydraulic fluid under pressure comprising a dual power source which can be an electrically driven pump and a manually operated foot pump;

C. A reservoir for said hydraulic fluid, said reservoir being at substantially atmospheric pressure;

D. Control valve means, connected in circuit intermediate said source of hydraulic fluid under pressure, said reservoir, and said hydraulic cylinders, selectively operable to direct hydraulic operating fluid to and from selected hydraulic cylinders to extend and retract said operating rods said control valve means comprising;

i. a normally closed, electrically operated extension valve connected between each of said hydraulic cylinders and said electric pump;

ii. a normally closed, electrically operated retraction valve connected between each of said hydraulic cylinders and said reservoir;

iii. a manual selector valve, connected betwen said cylinders and said manually operated pump, being operable to direct hydraulic fluid from said manually operated pump to any one of said hydraulic cylinders;

iv. a normally closed, manually operated dump valve, connected to said manual selector valve and said reservoir, whereby opening of said dump valve will cause said cylinder that is connected to said manual selector valve to return the hydraulic fluid in it to said reservoir; and E. Emergency bypass hydraulic circuit means for draining hydraulic fluid from said cylinders to said reservoir without use of said control valve means to thereby allow faster retraction of said operating rods and consequent faster lowering of said head, thigh and leg portions than is allowed by said control valve means.

2. The combination of claim 1 wherein said head portion is operated by two hydraulic cylinders which operates as a unit and are controlled by a single extension valve and a single retraction valve.

3. The combination of claim 1 which further includes:

A. A hydraulic elevation cylinder having an extensible and retractable operating rod connected to said rigid platform;

B. A base frame to which said hydraulic elevation cylinder is attached; and

C. Second control valve means, connected in circuit intermediate said source of hydraulic fluid under pressure, said reservoir and said hydraulic elevation cylinder, selectively operable to direct hydraulic fluid to and from said hydraulic elevation cylinder to thereby raise and lower said rigid platform, said second control valve means being connected such that it will not allow hydraulic fluid to flow through said emergency bypass hydraulic circuit means, thereby maintaining said rigid platform at its chosen elevation when said emergency hydraulic circuit means is activated.

4. The combination of claim 1 wherein said emergency bypass hydraulic circuit includes:

A. A normally closed, manually operated emergency valve, connected in circuit to all of said hydraulic cylinders and to said reservoir and bypassing said control valve means; and B. A one way check valve, connected in circuit intermediate each of said hydraulic cylinders and said emergency valve and positioned to allow hydraulic fluid flow only away from said hydraulic cylinders.

* * * * *